US006217042B1

(12) United States Patent
Kurtz et al.

(10) Patent No.: US 6,217,042 B1
(45) Date of Patent: Apr. 17, 2001

(54) GOLF CLUB TRAVEL CASE

(76) Inventors: Richard D. Kurtz, 1280 Sunset Rd., Ann Arbor, MI (US) 48103; Martin S. Farese, 18 Shrewsbury La., Rumson, NJ (US) 07760

( * ) Notice: Subject to any disclaimer, the term of this patent is extended or adjusted under 35 U.S.C. 154(b) by 0 days.

(21) Appl. No.: 09/275,330

(22) Filed: Mar. 24, 1999

(51) Int. Cl.[7] ..... B62B 1/14

(52) U.S. Cl. ..... 280/37; 280/47.26; 280/DIG. 6; 206/315.6

(58) Field of Search ..... 280/37, 47.17, 280/47.19, 47.26, 63, 79.2, DIG. 6; 206/315.2, 315.3, 315.4, 315.5, 315.6, 315.8; 190/119, 120

(56) References Cited

U.S. PATENT DOCUMENTS

| | | | | |
|---|---|---|---|---|
| 1,189,879 | | 7/1916 | Shamberg | 206/315.6 |
| 1,325,692 | | 12/1919 | Cross | 206/315.4 |
| 1,437,349 | | 11/1922 | Moore, Jr. | 2063/315.6 |
| 1,442,906 | | 1/1923 | Rawlings et al. | 206/315.4 |
| 1,600,601 | * | 9/1926 | Sampson | 206/315.2 |
| 1,628,771 | * | 5/1927 | Frisk | 206/315.3 |
| 1,636,194 | | 7/1927 | Mullins | 224/579 |
| 2,010,166 | | 8/1935 | Thompson | 206/315.6 |
| 2,023,792 | | 12/1935 | Sampson | 206/315.4 |
| 2,047,079 | | 7/1936 | MacMurrary | 224/613 |
| 2,428,954 | * | 10/1947 | Apblett et al. | 280/47.26 |
| 2,837,346 | | 6/1958 | Chambless | 280/37 |
| 2,911,228 | * | 11/1959 | Green | 280/DIG. 6 |
| 3,147,022 | * | 9/1964 | Amendola | 280/37 |
| 3,530,919 | | 9/1970 | May | 206/315.4 |
| 3,738,677 | * | 6/1973 | Renock | 280/37 |
| 4,182,391 | * | 1/1980 | Kjose | 206/315.5 |
| 4,576,307 | * | 3/1986 | Frydenberg | 190/119 |
| 4,767,001 | | 8/1988 | Kim | 206/315.3 |
| 4,858,761 | | 8/1989 | Fumia | 206/315.3 |
| 4,905,827 | | 3/1990 | Kim | 206/315.3 |
| 5,002,185 | | 3/1991 | Schurman | 206/315.4 |
| 5,168,992 | | 12/1992 | Bowdy | 206/315.6 |
| 5,269,411 | * | 12/1993 | Hong | 206/315.6 |
| 5,333,731 | | 8/1994 | McCuaig | 206/315.6 |
| 5,415,284 | | 5/1995 | King | 206/315.6 |
| 5,544,743 | | 8/1996 | Hong | 206/315.3 |
| 5,582,290 | | 12/1996 | McCuaig et al. | 206/315.6 |
| 5,671,842 | * | 9/1997 | Jaworski | 280/DIG. 6 |
| 5,699,906 | | 12/1997 | Lombardo et al. | 206/315.3 |
| 5,769,220 | | 6/1998 | Hong | 206/315.3 |
| 5,894,914 | * | 4/1999 | Jubin | 190/119 |

FOREIGN PATENT DOCUMENTS

| | | | | |
|---|---|---|---|---|
| 207045 | * | 3/1957 | (AU) | 280/DIG. 6 |
| 733631 | * | 7/1955 | (GB) | 280/DIG. 6 |
| 1374242 | * | 11/1974 | (GB) | 280/47.26 |

* cited by examiner

*Primary Examiner*—Frank Vanaman
(74) *Attorney, Agent, or Firm*—MacMillan, Sobanski & Todd, LLC

(57) ABSTRACT

A golf travel case includes first and second housings each having a club mounting wall surrounded at its periphery by a side wall and including an open side through which golf club retainers are accessible. A spacer is pivotally connected along opposite edges to the first and second housings to permit movement to a closed position with the open sides facing one another, the free edges of the sides walls interlocking and the spacer abutting the side walls. In the closed position of the case, the clubs are protected during travel and storage. Each of the housings can be independently pivoted relative to the spacer through an arc of more than 180° to an open position of the case for playing golf.

19 Claims, 4 Drawing Sheets

GOLF CLUB TRAVEL CASE

BACKGROUND OF THE INVENTION

The present invention relates generally to a golf club carrying case designed for travelling. More specifically, the present invention relates to a golf club case that functions as both a golf bag and a travel case.

A golfer's clubs often represent a significant investment in money and time. Modem clubs are expensive. In addition, since many golfers are likely to have a favorite putter, favorite wedges, favorite drivers, etc. that have been acquired separately, a golfer's clubs represent a unique and irreplaceable set. Finally, golfers spend countless hours becoming familiar with their own clubs. With these factors in mind, it's no wonder that every golfer prefers to use his own clubs. In fact, most golfers keep their clubs in the car, always available for the unexpected opportunity to play a few holes or just hit some balls.

Business and vacation travel, however, present a dilemma: the average golf bag is open, heavy, and cumbersome, which makes it difficult to check as airline baggage or include in a fully loaded vehicle. On business trips, clothing, documents, samples, a laptop computer, etc. all take priority over a golf bag. And while the golf bag may be given greater priority for vacation travel, the overall bulk of the bag frequently means it gets left at home because using rental clubs is often much more convenient.

A number of inadequate solutions to this problem can be found in the marketplace. Most standard circular golf bags come with covers that can be snapped or zipped on over the exposed club heads. While such covers keep the clubs in the bag, they do little to protect the heads of the clubs. If the bag is dropped, thrown, or has other luggage or cargo packed on top of it, the club head, shafts, and the bag itself feel almost the full force of the impact. Further, covers offer little or no security, accessory pockets remain readily accessible and even if locked on, covers can easily be slit.

A slight improvement over a cover for the club heads are full-length bag covers made of heavy-duty fabric. Full covers have the advantage of protecting the outside of the bag from moisture and dirt and a locking zipper may provide some security. However, while perfect for the car, such covers provide insufficient protection against the abuse that checked luggage undergoes.

Offering slightly better security are cases that are readily available in discount sporting goods stores. Such cases are typically configured as a clamshell or a pair of telescoping tubes. These cases are sized to hold a standard golf bag, and usually permit the addition of a padlock to prevent a casual thief from searching for desirable items. While these bags provide some protection during travel, the heads of the club are typically not protected unless the user takes the time to wrap them individually.

A cross between soft covers and hard-shell cases are the cases described in U.S. Pat. No. 4,767,001 to Kim and U.S. Pat. No. 5,002,185 to Schurman. These patents both describe hard-shell conventionally shaped cases that have auxiliary covers to protect the club heads. However, both bags are extremely bulky and the club heads are free to move.

U.S. Pat. No. 5,699,906 to Lombardo, et al. describes a bag configured for use on motorized carts having a padded hinged cover that holds the club heads in place. While offering improved protection for the clubs, the described bag is large, conventionally shaped, and appears best suited for semi-permanent attachment to a powered golf cart.

Because a standard golf bag permits the club heads and shafts to move around it is difficult for any case or protective device designed for use with a standard bag to really secure the clubs. In addition, such cases and protective devices add to the significant bulk and weight of standard bags.

Cases configured for travel are described in U.S. Pat. No. 4,858,761 to Fumia, U.S. Pat. No. 5,168,992 to Bowdy, and U.S. Pat. No. 5,582,290 to McCuaig, et al. Unfortunately, all of these cases are poor substitutes for a standard golf bag. The manner in which these cases are configured results in an awkward presentation of the clubs for play, requires that they be mounted on a cart or carried, and dictates that in many situations the cases must be closed after a club has been selected in order to permit the case to be moved.

SUMMARY OF THE INVENTION

The present invention concerns a golf travel case that is light and slim and holds each of the clubs individually to protect them from damage during travel. The case can be securely closed to discourage casual theft and make it easy to transport. When open, the case gives easy access to all the clubs during play.

A golf travel case according to the present invention includes a first housing having a first mounting wall surrounded at its periphery by a first side wall, the first housing being elongated and generally cup shaped with an open side at a free edge of the first side wall. A means for retaining "irons" in a heads up position is attached to an interior surface of the first housing and includes a club head retainer being divided into a plurality of compartments formed between adjacent dividers angled with respect to vertical to correspond with an angle of an associated club head relative to the shaft to which it is attached. The case also includes a mating second housing having a mounting wall surrounded at its periphery by a second side wall, the second housing being elongated and generally cup shaped with an open side at a free edge of the second side wall, the free edge of the first side wall mating with the free edge of the second side wall when the open sides are facing each other. A means for retaining "woods" in a heads down position is attached to an interior surface of the second housing. An elongated spacer is pivotally connected along one edge to a longer portion of the first side wall and pivotally connected along another edge to a longer portion of the second side wall whereby when the free edges of the first and second side walls are engaged, the golf travel case is in a closed position and the spacer abuts outer surfaces of the first and second side walls, and wherein the first and second housings are individually pivotable relative to the spacer to open the golf travel case, each of the first and second housings being pivotable through an arc greater than 180° to a fully open position of the golf travel case wherein exterior surfaces of the first and mounting walls abut.

One object of the present invention is to provide a golf travel case that is configured to be easily transported by car or as checked airline luggage.

Another object of the present invention is to provide a golf travel case that protects the clubs during travel and can be fixed in an open configuration to permit the clubs to be played directly out of the case.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
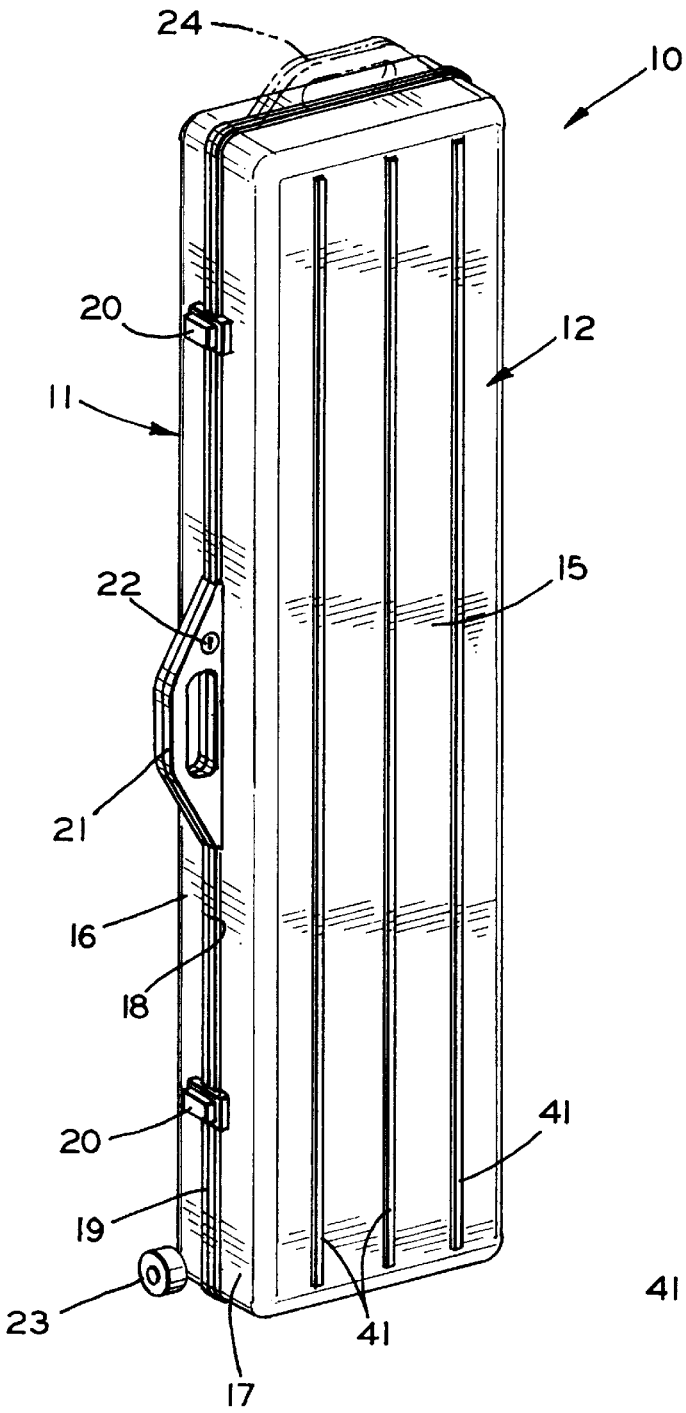
FIG. 1 is a perspective view of an embodiment of a golf travel case according to the present invention in a closed position for travel or storage.

There is shown in the FIGS. 1–5 a golf travel case 10 according to the present invention. The case 10 is formed by a pair of generally cup-shaped elongated housings including a first housing 11 and a second housing 12 attached to one another by hinge means. The housings 11 and 12 are generally rectangular in shape with rounded corners and an open side. The open sides of the housings 11 and 12 face one another in a closed position as shown in the FIG. 1 to form a closed container of a size sufficient to hold a set of golf clubs. As explained below, the first housing 11 is adapted to retain "irons" type golf clubs and the second housing 12 is adapted to retain "woods" type golf clubs. The housings 11 and 12 are pivotally connected to each other with the hinge means in the form of a backplate or spacer 13 that permits the housings to be rotated from the closed position to a fully open position as shown in the FIG. 5.

Figure 2:
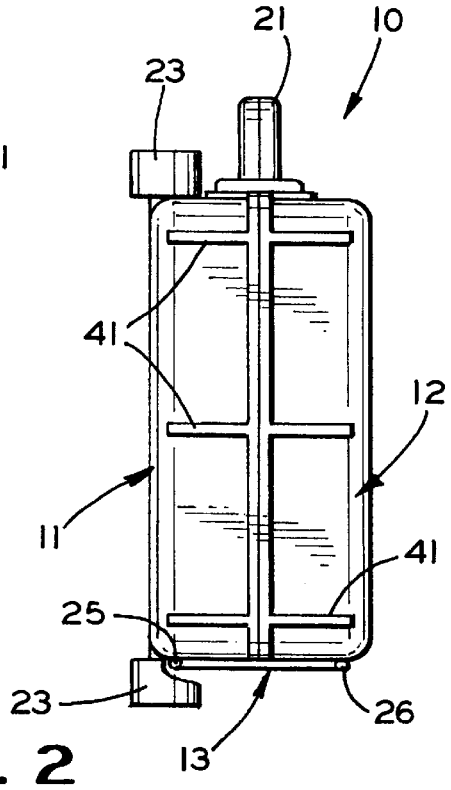
FIG. 2 is a bottom plan view of the case shown in the FIG. 1.

The first housing 11 and the second housing 12 each have a generally planar mounting wall, 14 and 15 respectively, each surrounded at its periphery by a raised side wall, 16 and 17 respectively. The raised side walls 16 and 17 include generally parallel shorter portions connecting generally parallel longer portions and have facing free edges, 18 and 19 respectively, that are configured to interlock with each other when the case 10 is closed. At least one latch mechanism for securing the first housing 11 and the second housing 12 in the closed position shown in the FIGS. 1 and 2 is also provided. This latch mechanism can be, for example, a pair of conventional manually actuated clasps or snap locks 20 spaced apart with cooperating parts mounted on one of the longer portions of the side walls 16 and 17 adjacent the free edges 18 and 19. If desired, the snap locks 20 can include a key operated lock mechanism (not shown) for additional security.

A carrying handle 21 is provided for the case 10 and extends outwardly from one or both of the side walls 16 and 17 on the longer portions carrying the snap locks 20. The handle is positioned adjacent the free edges 18 and 19 approximately midway between the shorter portions of the side walls 16 and 17. The handle 21 is shown as being longitudinally split having a half portion attached to each of the housings 11 and 12, but the entire handle could be attached to either one of the housings. When split between the two housings, the carrying handle 21 can include a lock mechanism 22 for securing the case 10 in the closed position. The lock mechanism 22 can be in addition to or instead of a lock mechanism in the snap locks 20.

In addition to the carrying handle 21 for hand carrying the case 10, a wheel means can be provided for pulling the case along. For example, the wheel means can be a pair of wheels 23 rotatably mounted at opposite lower corners of the housing 11 in the orientation of the case 10 as shown in the FIG. 1. The wheels 23 can be mounted on individual stub axles (as shown) or on opposite ends of a single axle (not shown) that extends through the interior of the housing 11. A second handle 24, shown in phantom in the FIG. 1, can be provided on the upper side of the case 10 to assist in pulling the case along on the wheels 23. The handle 24 can be permanently attached or detachable, and can take other forms such as a tab or strap to provide a convenient handhold. The wheels 23 and the handle means 24 are useful for pulling the case 10 through airports and hotels especially when burdened with luggage, a briefcase, a portable computer, etc. Alternatively, the wheels 23 could be mounted on the second housing 12.

Figure 3:
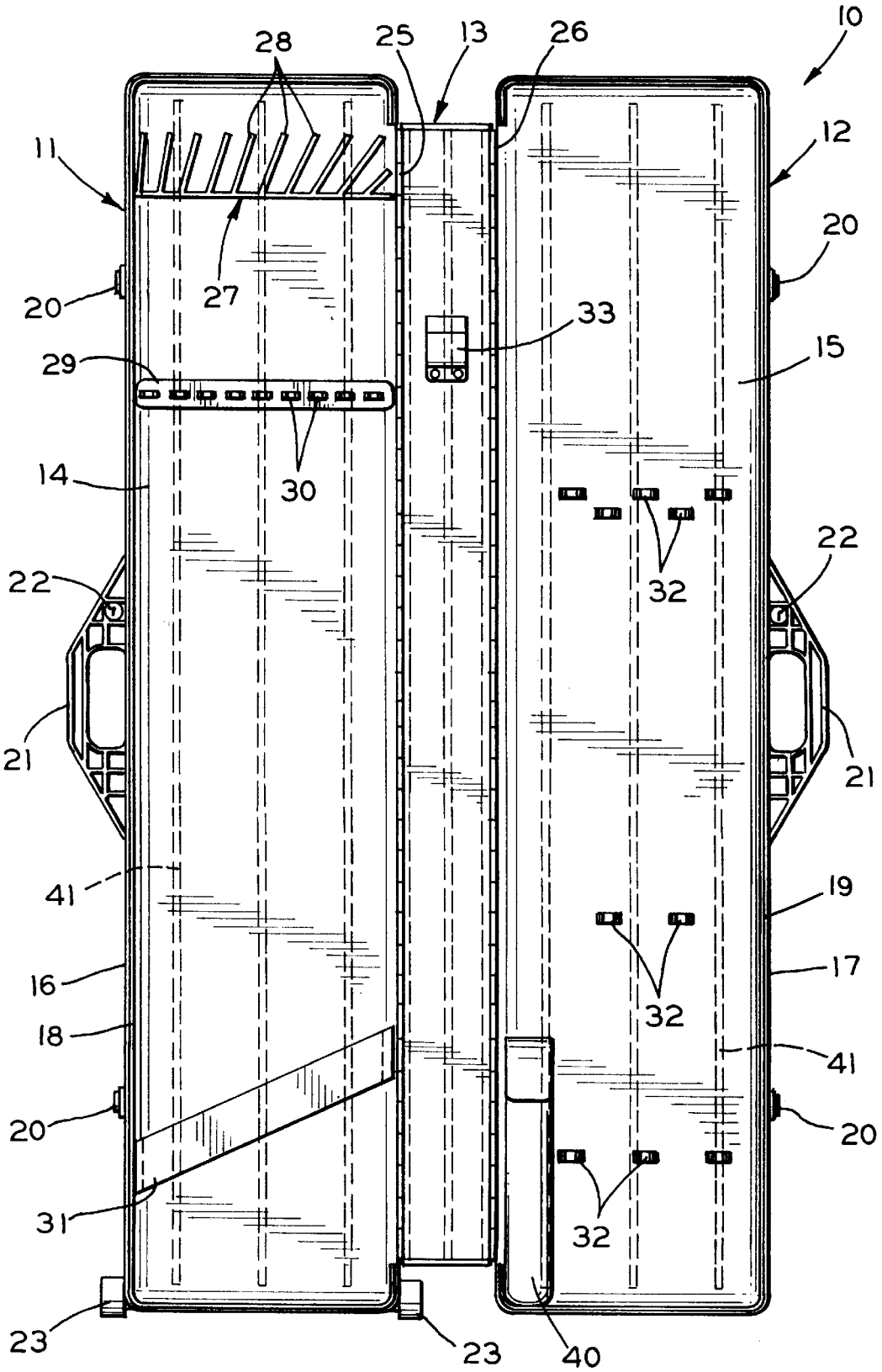
FIG. 3 is an elevational view of the case shown in the FIG. 1 in an intermediate open position.
Figure 4:
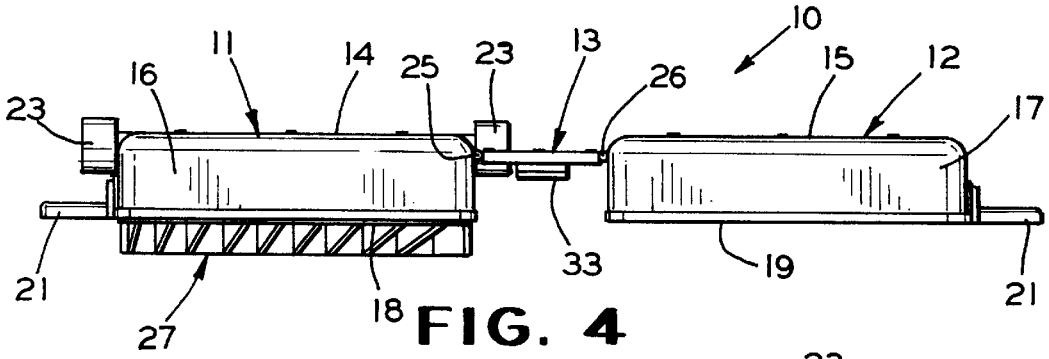
FIG. 4 is a top plan view of the case in the intermediate open position as shown in the FIG. 3.
Figure 5:
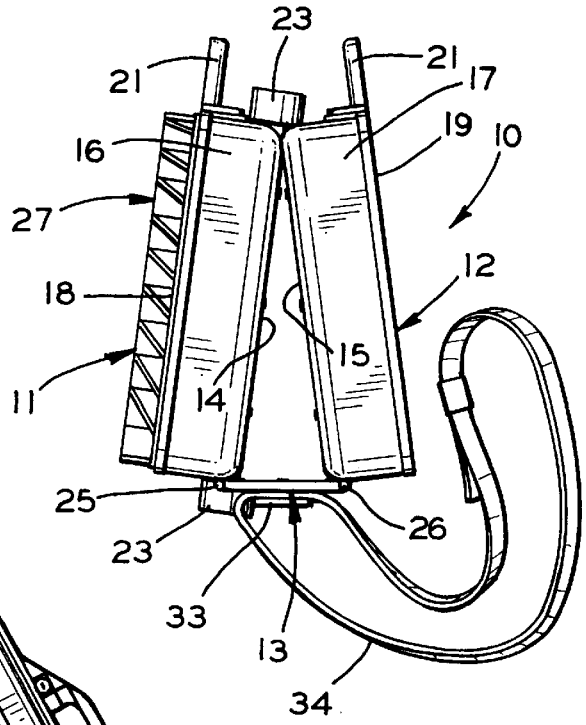
FIG. 5 is a top plan view of the case shown in the FIG. 1 in a fully open position for playing golf.

The spacer 13 joins the first housing 11 and the second housing 12 together along substantially the entire length of one of the longer portions of the side walls 16 and 17 as best shown in the FIG. 3. The spacer 13 may be pivotally fixed at any convenient point along the side walls 16 and 17 that permits the first housing 11 and the second housing 12 to be closed together as shown in the FIG. 1, and then opened so that each housing rotates in excess of 180° relative to the spacer. When the case 10 is closed, the spacer 13 lies substantially flat against the outer surfaces of the side walls 16 and 17. As shown in the FIG. 4, the housings 11 and 12 each can be rotated approximately 90° from the closed position to an intermediate position that is useful if it is desired to rest the case 10 flat on a surface such as a floor or lean the case against a wall. In the position shown in the FIG. 4, the entire interior of the case is exposed in a single plane for conveniently examining the contents or packing and unpacking. As shown in the FIG. 5, the first housing 11 and the second housing 12 can be rotated to a fully open position wherein the outer surfaces of the mounting walls 14 and 15 are positioned facing each other and actually touch adjacent the handle 21. In the fully open position, the case 10 displays the entire contents and is in a compact configuration that fits on a golf cart in a manner similar to a conventional golf bag.

The spacer 13 is provided with a pair of hinges 25 and 26 each similar to a typical piano hinge. For example, the hinge 25 has a first elongated portion attached to the spacer 13 and a second elongated portion attached to the first housing 11 on an exterior surface of the side wall 16. The elongated portions of the hinge 25 each have a plurality of spaced apart tubular portions that cooperate to form an aligned tube in which a hinge pin or rod is received to form a swinging joint. The hinge 26 is similar in construction to the hinge 25 and the hinges function independent of one another.

The housings 11 and 12 can be made of any suitable material that is strong enough to stand up to the rigors of travel and use as a golf bag. For example, a metal material such as aluminum or a high impact plastic material. Preferably, the housings 11 and 12 are molded from a suitable plastic material such as an ultra-high molecular weight polyethylene. The free edges 18 and 19 can be formed as a complementary tongue and groove to provide a positive mating and a seal. The tongue and groove can be molded on the side walls 16 and 17 or attached in the form of separate pieces such as an aluminum, or other metal, extrusion as is typically utilized on hard sided luggage. The spacer 13 can be formed from the same material as the housings 11 and 12, while the hinges 25 and 26 are typically fabricated from a metal material such as chrome plated stainless steel.

The mounting walls 14 and 15 each have an interior generally planar surface against which golf clubs will be retained. It is preferable that the interior mounting surfaces have a soft facing of a suitable material such as a thermoplastic elastomer available under the brand name Sanoprene®. As best shown in the FIG. 3, the irons are retained in the first housing 11 of the travel case 10 with the grip or handle of each club adjacent a lower end where the wheels 23 are attached and a head at the top of the case. The head of each iron rests in its own corresponding compartment formed in a club head retainer 27 mounted in the first housing 11 near the upper end thereof and extending between the longer portions of the side wall 16. The compartments are formed between adjacent pairs of dividers 28 angled with respect to vertical to correspond to the angle of the associated club head relative to the shaft to which it is attached. From left to right the compartments retain the "5" through "9" irons, the pitching wedge and the sand wedge. The club head retainer can be a separate part attached to the first housing 11 or molded integral therewith.

Positioned below the club head retainer 27 in the first housing 11 is a multiple club retainer 29 that extends between the longer portions of the side walls 16 and 17. The retainer 29 has a plurality of clips 30 either attached thereto or molded integral therewith for retaining a lower section of the shaft of each corresponding club. Positioned adjacent the bottom of the housing 11 is a club handle retainer plate 31 spaced from the interior surface of the mounting wall 14 for holding the grip or handle portion of the irons. The retainer plate 31 extends between the side walls 16 and 17 at an angle corresponding generally to the relative lengths of the club shafts.

The woods are retained in the second housing 12 with the heads at the lower end and the grips at the upper end. Attached to the interior surface of the mounting wall 15 of the second housing 12 is a plurality of single club retainers or clips 32 for holding the woods. Five of the clips 32 are mounted above the handle 21 in two horizontal rows for holding upper sections of the clubs shafts. From left to right, the three clips 32 in the upper row hold the upper ends of the "1" through "3" woods and the two clips in the lower row hold the upper ends of a spare club and the putter. Positioned below the handle 21 in the second housing 12 are two of the clips 32 for holding the lower ends of the spare club and the putter. Positioned adjacent the bottom of the second housing 12 is a row of three of the clips 32 for holding the lower ends of the "1" through "3" woods. The multiple club retainer 29, the club handle retainer plate 31, and the single club retainers 32 can be molded from the same material as the housings 11 and 12. The clips 30 and 32 are generally C-shaped with a resilient pair of opposed legs that can be forced apart to slide a club shaft into and out of.

The ultra-high molecular weight polyethylene from which the case 10 components are preferably formed is presently used by the U.S. military because it is so durable. In fact, embodiments of the invention described herein when manufactured using ultra-high molecular weight polyethylene, exceed the Airline Transportation Association (ATA) specifications 300, category 1. This means that such a golf travel case will easily withstand more than 100 trips by air.

A golf travel case 10 of the present invention can be fabricated to hold any number of clubs. The configuration shown in the drawings holds fourteen clubs including oversized 46" drivers. A smaller, more compact configuration can hold six clubs. The fourteen club configuration encloses about 2400 cubic inches and weighs about twenty-two pounds including the clubs. Compact cases that hold only six clubs are particularly convenient for international travel.

Figure 6:
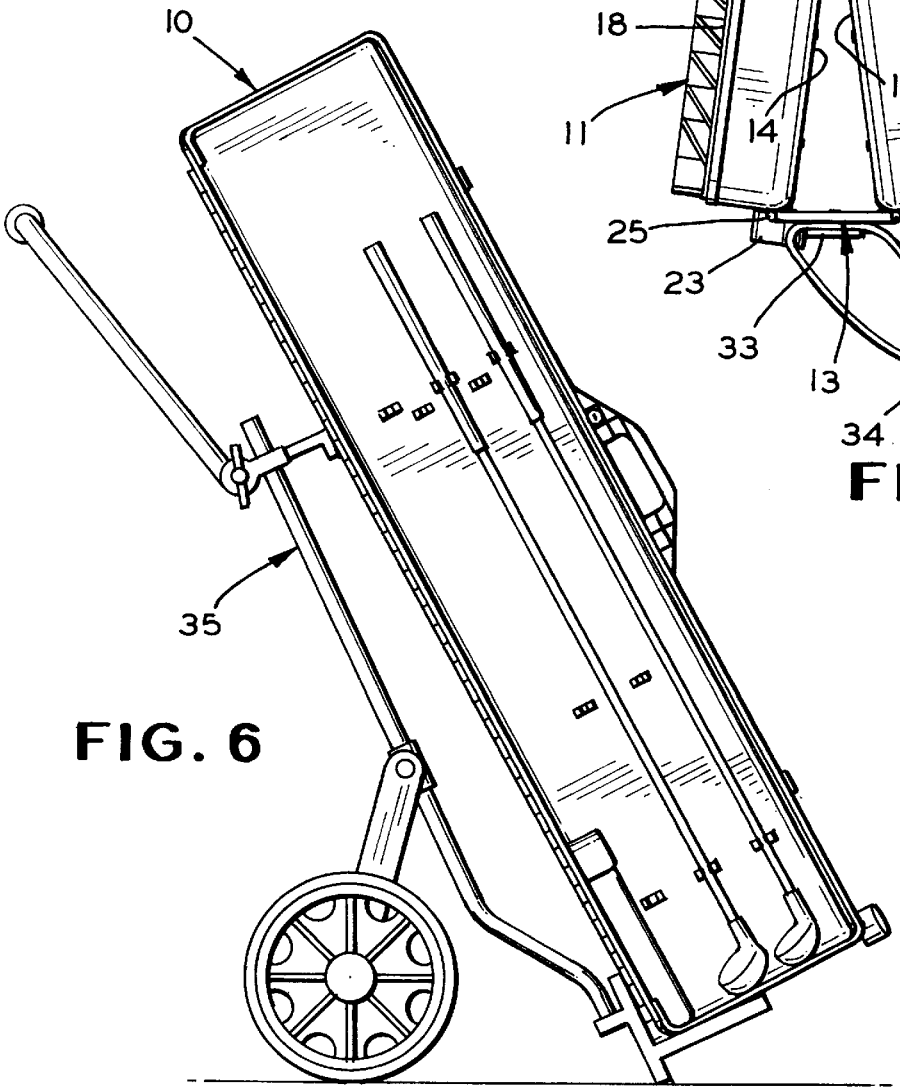
FIG. 6 is a side elevation view of the case shown in the FIG. 5 mounted on a golf hand cart.

The case 10 can be used in the same manner as a typical golf bag to play golf. A strap retainer clip 33 is attached to an interior surface of the spacer 13 for releasably retaining a carrying strap 34. The strap 34 permits a golfer or a caddy to carry the case 10 supported from a shoulder. The case 10 also can be mounted on a typical hand cart 35 as shown in the FIG. 6. The strap 34 shown in the FIG. 5 could be used to secure the case 10 to the hand cart 35. As an alternative, the hand cart 35 could be formed as a collapsible carriage that attaches to the case 10 via the wheels 23, the clip 33 and/or the handle 21.

Figure 7:
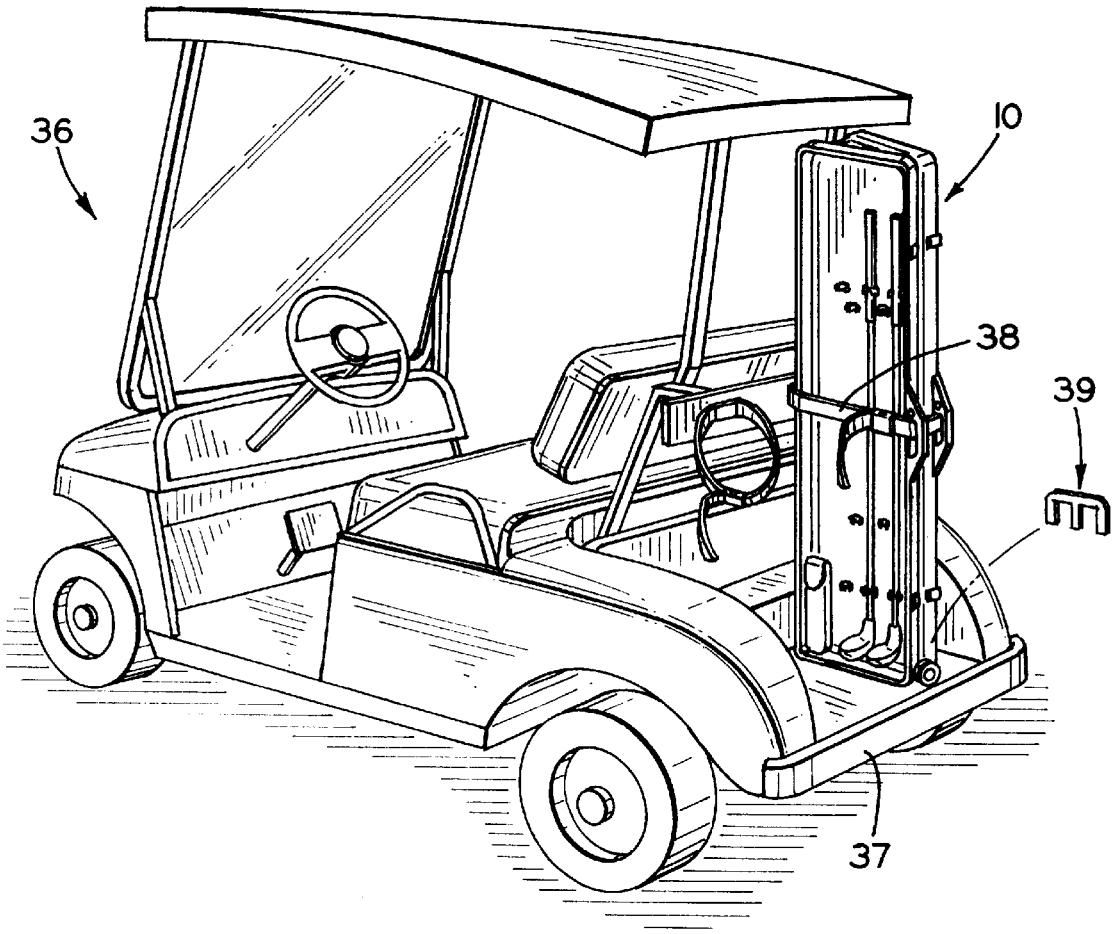
FIG. 7 is a perspective view of the case shown in the FIG. 5 mounted on a motorized golf cart.

The case 10 also can be used with a typical riding type motorized golf cart 36 as shown in the FIG. 7. The cart 36 has bag golf bag carrying area at the rear typically terminated by an upstanding rear bumper 37 or lip. In addition, a pair of bag straps 38 is located behind and near the top of the seat backs. The bag strap 38 can engage the strap retainer clip 33 shown in the FIG. 5 to secure the case 10 in the cart 36. If the bag strap 38 is not available, or if additional support is required, a generally inverted W-shaped bracket 39 can be provided. One leg of the bracket 39 fits over the lip 37 and the other leg engages the case 10 in any suitable manner such as cooperating with the snap lock 20 or a similar latching means (not shown).

In addition to carrying golf clubs, the case 10 can be provided with accessory storage pockets for carrying accessories such as shoes, golf balls, tees, etc. For example, an accessory storage pocket 40 shown in the FIG. 3 can take the form of a removable closable bag. The bag 40 is shown as being positioned between the side wall 17 and the clip 32 for the "1" wood and similar bags can be located where space permits. It is preferred that such bags be zippered or provided with another type of closure such as a hook and loop pair and that they are removably secured inside the first housing 11 and/or the second housing 12 using fasteners.

To protect the outer surface of the case 10 from scrapes and scratches, the mounting walls 14 and 15 (FIGS. 1 and 3) and the bottom shorter portions of the side walls 16 and 17 (FIG. 2) can be provided with ribs 41 that are raised from the exterior surfaces. The ribs 41 on the mounting walls 14 and 15 are formed as spaced generally parallel flanges extending between the shorter portions of the side walls 16 and 17. The ribs 41 on the bottom of the case 10 are formed as spaced generally parallel flanges extending transverse from the free edges 18 and 19.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A golf travel case comprising:

a first housing having a first mounting wall surrounded at its periphery by a first side wall, said first housing being elongated and generally cup shaped with an open side at a free edge of said first side wall;

a second housing having a mounting wall surrounded at its periphery by a second side wall, said second housing being elongated and generally cup shaped with an open side at a free edge of said second side wall, said free edge of said first side wall mating with said free edge of said second side wall when said open sides are facing each other;

means for retaining golf clubs attached to an interior surface of at least one of said first and second housings; and an elongated spacer pivotally connected along one edge to a longer portion of said first side wall and pivotally connected along another edge to a portion of said second side wall whereby when said free edges of said first and second side walls are engaged, the golf travel case is in a closed position and said spacer abuts outer surfaces of said first and second side walls, and wherein said first and second housings are individually pivotable relative to said spacer to open the golf travel case, each of said first and second housings being pivotable through an arc greater than 180° to a fully open position of the golf travel case wherein exterior surfaces of said first and mounting walls abut.

2. The golf travel case according to claim 1 wherein said first and second housings and said spacer are formed from an ultra-high molecular weight plastic material.

3. The golf travel case according to claim 1 configured such that said first and second housings and said means for retaining are adapted to hold a set of 14 golf clubs.

4. The golf travel case according to claim 1 configured such that said first and second housings and said means for retaining are adapted to hold a set of 14 golf clubs including oversized drivers.

5. The golf travel case according to claim 1 wherein interior surfaces of said first and second housings are coated with a soft facing material.

6. The golf travel case according to claim 5 wherein said soft facing material is a thermoplastic elastomer.

7. The golf travel case according to claim 1 wherein said free edges of said first and second side walls are formed as a complementary tongue and groove for mating and sealing said first and second housings together in the closed position of the golf travel case.

8. The golf travel case according to claim 1 including at least one latch mechanism attached to said first and second side walls for securing said first and second housings together in the closed position of the golf travel case.

9. The golf travel case according to claim 1 including a handle attached to at least one of said first and second side walls for hand carrying the golf travel case.

10. The golf travel case according to claim 1 including at least one lock mechanism attached to said first and second side walls for securing said first and second housings together in the closed position of the golf travel case.

11. The golf travel case according to claim 1 including a pair of ground engaging wheels rotatably attached to one of said first and second housings.

12. The golf travel case according to claim 1 including a pair of hinges attached to opposite edges of said spacer, each said hinge being attached to an associated one of said first and second side walls.

13. The golf travel case according to claim 1 wherein said means for retaining includes a club head retainer attached to an interior surface of said first mounting wall, said club head retainer being divided into a plurality of compartments formed between adjacent dividers, each said divider angled with respect to vertical whereby a club head of an "iron" golf club can be retained in each said compartment.

14. The golf travel case according to claim 1 wherein said means for retaining includes a clip for releasably retaining a golf club shaft attached to an interior surface of one of said first and second housings.

15. The golf travel case according to claim 1 wherein said means for retaining includes a club handle retainer plate attached to an interior surface of said first housing for releasably retaining golf club handles.

16. The golf travel case according to claim 1 including a strap retainer clip attached to an interior surface of said spacer for releasably securing a carrying strap.

17. The golf travel case according to claim 1 including at least one accessory storage pocket releasably attached to an interior surface of one of said first and second housings.

18. A compact golf travel case comprising:

a first housing having a first mounting wall surrounded at its periphery by a first side wall, said first housing being elongated and generally cup shaped with an open side at a free edge of said first side wall;

means for retaining "irons" attached to an interior surface of said first housing;

a second housing having a mounting wall surrounded at its periphery by a second side wall, said second housing being elongated and generally cup shaped with an open side at a free edge of said second side wall, said free edge of said first side wall mating with said free edge of said second side wall when said open sides are facing each other;

means for retaining "woods" attached to an interior surface of said second housing; and an elongated spacer pivotally connected along one edge to a longer portion of said first side wall and pivotally connected along another edge to a portion of said second side wall whereby when said free edges of said first and second side walls are engaged, the golf travel case is in a closed position and said spacer abuts outer surfaces of said first and second side walls, and wherein said first and second housings are individually pivotable relative to said spacer to open the golf travel case, each of said first and second housings being pivotable through an arc greater than 180° to a fully open position of the golf travel case wherein exterior surfaces of said first and mounting walls abut.

19. A compact golf travel case comprising:

a first housing having a first mounting wall surrounded at its periphery by a first side wall, said first housing being elongated and generally cup shaped with an open side at a free edge of said first side wall;

means for retaining "irons" in a heads up position attached to an interior surface of said first housing including a club head retainer being divided into a plurality of compartments formed between adjacent dividers angled with respect to vertical whereby a club head of an "iron" golf club can be retained in each said compartment;

a second housing having a mounting wall surrounded at its periphery by a second side wall, said second housing being elongated and generally cup shaped with an open side at a free edge of said second side wall, said free edge of said first side wall mating with said free edge of said second side wall when said open sides are facing each other;

means for retaining "woods" in a heads down position attached to an interior surface of said second housing; and an elongated spacer pivotally connected along one edge to a portion of said first side wall and pivotally connected along another edge to a portion of said second side wall whereby when said free edges of said first and second side walls are engaged, the golf travel case is in a closed position and said spacer abuts outer surfaces of said first and second side walls, and wherein said first and second housings are individually pivotable relative to said spacer to open the golf travel case, each of said first and second housings being pivotable through an arc greater than 180° to a fully open position of the golf travel case wherein exterior surfaces of said first and mounting walls abut.

* * * * *